US005803134A

United States Patent [19]

Smith

[11] Patent Number: 5,803,134

[45] Date of Patent: Sep. 8, 1998

[54] CREEL AND YARN PACKAGE HOLDERS WITH QUICK STOP MECHANISM

[75] Inventor: Colin Philip Smith, Knutsford, Great Britain

[73] Assignee: Texkimp Limited, Northwich, United Kingdom

[21] Appl. No.: 903,710

[22] Filed: Jul. 31, 1997

Related U.S. Application Data

[63] Continuation of Ser. No. 545,808, filed as PCT/GB94/00970 May 5, 1994 published as WO94/26646 Nov. 24, 1994, abandoned.

[30] Foreign Application Priority Data

May 6, 1993 [GB] United Kingdom ..... 93099305

[51] Int. Cl.[6] ..... B65H 59/04

[52] U.S. Cl. ..... 139/194; 242/156.2; 242/131; 28/194

[58] Field of Search ..... 139/450, 194; 242/156.2, 421.5, 421.8, 421.9, 156, 131, 131.11; 28/194

[56] References Cited

U.S. PATENT DOCUMENTS

| | | | |
|---|---|---|---|
| 1,462,604 | 7/1923 | Lavalle | 242/156.2 X |
| 3,409,194 | 11/1968 | Whitehead | 28/194 X |
| 3,540,675 | 11/1970 | Goldsworthy | 242/156.2 |
| 3,731,889 | 5/1973 | Alexeff . | |
| 5,451,006 | 9/1995 | Smith | 242/131.1 |

FOREIGN PATENT DOCUMENTS

| | | |
|---|---|---|
| 898225 | 4/1972 | Canada . |
| 1369072 | 6/1964 | France . |
| 1445427 | 5/1966 | France . |
| 397129 | 8/1922 | Germany . |
| 1931659 | 8/1970 | Germany . |
| 576994 | 4/1946 | United Kingdom . |
| 1413446 | 11/1975 | United Kingdom . |

*Primary Examiner*—Andy Falik
*Attorney, Agent, or Firm*—Jenkins & Wilson, P.A.

[57] ABSTRACT

A yarn package holder on a creel, with a mechanism for rapidly stopping the yarn package holder once yarn is no longer being drawn. The mechanism has a pivoted member, one end of which carries a transverse braking control arm that overlies the yarn, and the other end of which is secured to an end of a tensioning cord wrapped at least once around a pulley on the yarn package holder. When yarn is being drawn, the braking control arm is lifted, which has the effect the loosening the cord around the pulley so that the braking effect is small. When yarn is no longer drawn, the braking control arm drops, which has the effect of tightening the cord around the pulley and rapidly stopping the yarn package holder.

10 Claims, 2 Drawing Sheets

CREEL AND YARN PACKAGE HOLDERS WITH QUICK STOP MECHANISM

This is a continuation of application Ser. No. 08/545,808, filed as PCT/GB94/00970 May 5, 1994 published as WO94/26646 Nov. 24, 1994, abandoned.

FIELD OF THE INVENTION

This invention relates to a creel having rotating yarn packages.

DESCRIPTION OF THE PRIOR ART

Yarns are arranged to be drawn from yarn pacrkages on a creel under tension, the tension arising because the yarn packages are rotated against a force, commonly supplied by a strap or cord and pulley arrangement. The tension is not required to be high and as a result, when machine or beam which is being supplied by the creel stops, the yarn packages may continue to rotate for a period, during which time the yarns continue to unwind, leading to the yarns dangling loosely within the creel. This can lead to problems, such as entanglement, which can delay start up of the machine.

SUMMARY OF THE INVENTION

In accordance with the present invention there is provided a creel having a plurality of yarn package holders of the rotating type, each yarn package holder having a pulley and a flexible elongate member wound at least once around the pulley, each yarn package holder having a mechanism which responds to loss of tension in the yarn being drawn from a yarn package on the yarn package holder, to tighten the flexible elongate member around the pulley, to effect braking.

In this specification, the term "brake" denotes the relatively high force applied to the yarn package by the flexible elongate member, when it has been tightened, which stops the yarn package holder.

Preferably, the mechanism for each yarn package holder comprises a pivoted member which comprises a braking control arm extending transversely with respect to a yarn being drawn from a yarn package located on the yarn package holder. The yarn runs under the braking control arm, in contact with it. The flexible elongate member is secured to the pivoted member. When a machine or beam is running and a yarn is being drawn from a yarn package the braking control arm is raised by the yarn, which runs straight, or without substantial deviation, beneath it. In this condition the flexible elongate member is not tight around the pulley. When the machine or beam stops, the yarn tension is lost, the braking control arm drops and thereby turns the pivoted member as a whole. This has the effect or tightening the flexible elongate member around the pulley, to brake the yarn package holder, and hence arrest the yarn package.

Suitably the pivoted member has a horizontal pivot, and the braking control arm, and the securement position of the flexible elongate member, are located to either side of the pivot.

Suitably one end of the flexible elongate member is secured to the pivoted member, and the other to a fixed part of the creel.

Suitably the yarn being drawn from a yarn package is tensioned wholly or mainly by the pivoted member, which has to be lifted by the yarn in order for the yarn package holder to rotate. The pivoted member may be provided with an adjustable counterweight, and/or be subject to an adjustable spring force (as described further hereinafter) so that the yarn tension during normal running is adjustable.

Each yarn package holder may have a frame member associated with it. The frame member may have parallel bars extending substantially parallel to the axis of the yarn package holder, which, may be spanned by two adjustable cross members. The yarn may be drawn above the front bar of the frame member. Thus, the frame member may define a bounded area through which the yarn may be drawn; correct positioning of the cross-members prevents the yarn from falling off the end of the yarn package. Furthermore a bar of a frame member may serve as a post about which a yarn may be run, to change its direction. This may be useful if it is wished to employ a vertical yarn take-oft system, as described in our PCT patent application Ser. No. PCT/GB92/00090, published as WO92/13123 on Aug. 6, 1992 and corresponding to U.S. Pat. No. 5,451,006 issued on Sep. 19, 1995, which is incorporated herein by reference.

The frame member may suitably be a U-shaped member retained above its yarn package, having the ends of its limbs, which serve as the said bars, secured to a fixed member. To this fixed member, the pivoted member may be pivotally mounted. To the fixed member or U-shaped member, one end of the flexible elongate member may be secured. One such fixed member may suitably carry two U-shaped members and pivoted members, one on each side, for respective yarn packages.

Preferably, means are provided to commonly control the tensioning and/or braking of the yarn packages of the creel. To this end the pivoted member may be biassed by a spring, which is also secured to a column which may be displaced substantially vertically, thereby to commonly adjust the spring forces of all the springs attached to the column. All of the columns arm, in their turn, commonly controlled by a single substantially horizontal control member. Such apparatus is further described in our above-mentioned PCT Patent Application. Alternatively the springs may be attached to adjustable substantially horizontal members which are, in their turn, commonly controlled by a single substantially vertical control member.

The extent to which the flexible elongate members needs to be wound around the pulley depends on the nature of the flexible elongate member and of the pulley. Empirically it is found that in order for a yarn package to be arrested when the flexible elongate member is tightened, it should be wound at least once around the pulley. Preferably, the flexible elongate member is wrapped around the pulley for at least 540°. The flexible elongate member may suitably be a braided polymeric cord and the pulley, a plastics moulding. Alternatively the flexible elongate member could be a flat belt or a resilient metal strip, optionally having a friction material on its contact surface. The pulley could be metallic, for example produced as a casting or spinning.

BRIEF DESCRIPTION OF THE DRAWINGS

The invention will now be further described, by way of example, with reference to the accompanying drawings, in which.

DESCRIPTION OF THE PREFERRED EMBODIMENTS

Each drawing shows a yarn package of a creel, the yarn package being mounted on a rotatable yarn package holder, and its associated tensioning/braking mechanism. The other rotating yarn packages of the creel are not Shown, but each has its own, identical, tensioning/braking mechanism.

Figure 1:
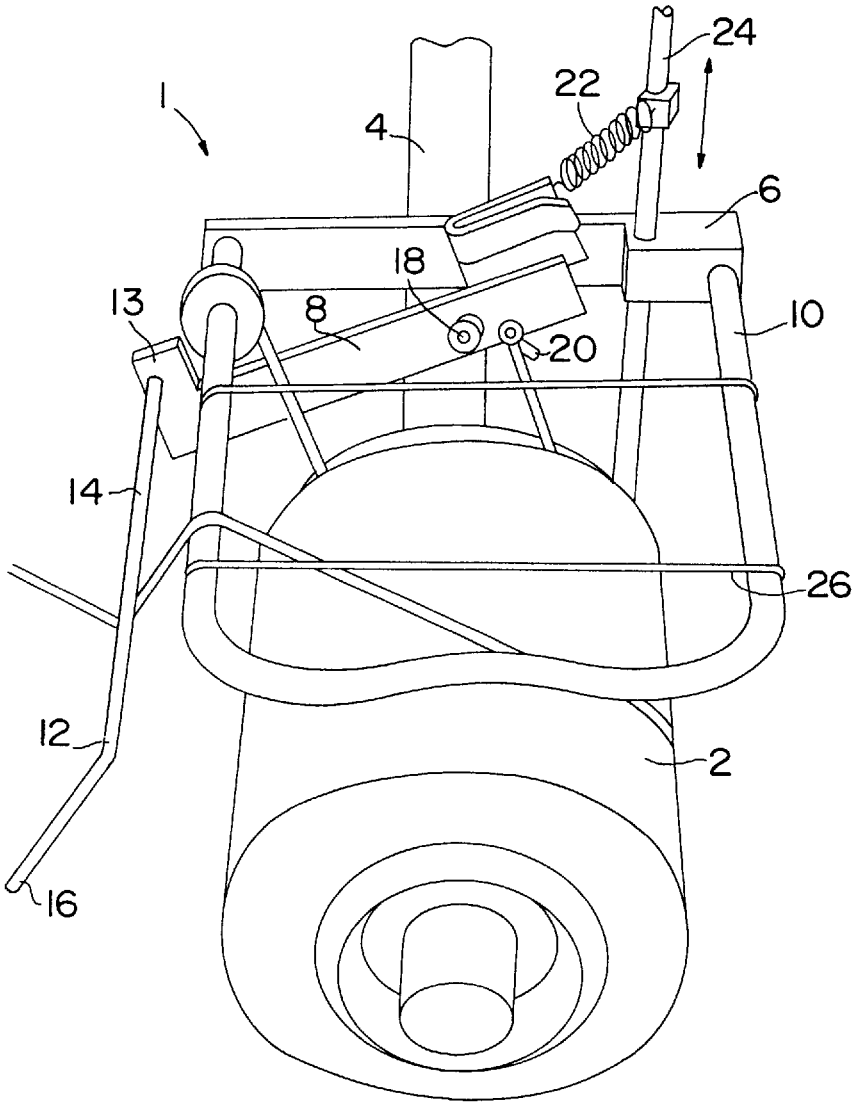
FIG. 1 shows, in schematic perspective view, a first embodiment in accordance with the invention.

In FIG. 1 there is shown a yarn package 2 of the rotating type, mounted on a yarn package holder or spindle for rotation about a horizontal axis, on a vertical support column 4 of the creel! Secured transversely to the vertical column 4 is a mounting plate 6, set in a vertical plans. Pivoted to this is a pivoted member 8, and secured fixedly to the plate 6 is a generally U-shaped member 10, of round bar form, which extends over the yarn package, with the limbs of the U-shaped member being parallel to the axis of the yarn package.

The pivoted member a comprises a braking control arm 12 of round bar form secured to, and extending transversely from, and 13. The arm 12 is L-shaped. Its portion 14 which contacts the yarn 8 is parallel to the axis of the yarn package, and is approximately the same length as the yarn package. From this portion 14 extends a downturn portion 16.

Secured towards the other end of the pivoted member 8, to the other side of the pivot 18 from the arm 12, is one end of a braided nylon cord 20. The other end of the cord 20 is secured to the front limb of the U-shaped frame 10. In between, the cord extends approximately 1½ times or more around a-plastics moulded pulley (not shown) secured to the inner end of the yarn package.

A helical spring 22 has one and secured to a part carried on an end of the pivoted member (the end opposite to the end from which extends the braking control arm 12). The other end of the spring is secured to a column 24 which is adjustable up and down, thereby to adjust the biasing of the pivoted member provided by the spring.

The other springs associated with the yarn packages in the same column as the yarn package 2 are also secured between respective pivoted members a and the column 24, whereby they way be commonly adjusted. Moreover, all of the columns in the creel are themselves commonly adjusted by means of a single horizontal adjustment member. Such a mechanism is described in more detail in our abovementioned PCT Patent Application ,published as WO92/13123 and corresponding to U.S. Pat. No. 5,451,006, and particularly in more detail with respect to element 70 in FIG. 7, which illustrates an example of a horizontal adjustment member, such members being well known to those ordinarily skilled in the art.

The U-shaped frame 10 optionally has, secured across its parallel limbs, two cross-members 26, these being formed of wire with hook formations at their ends. The cross-members may be located in any desired position between the limbs and, together with the limbs, define an area through which the yarn must be drawn from the yarn package. By this means, it is possible to constrain the yarn within the winding transverse length in order to prevent the yarn from falling off an end of the yarn package, during unwinding. The cross-members may be placed close together, or far apart, depending on the geometry of the yarn package and characterisation of the unwinding material.

The yarn drawn from the yarn package runs over the front limb of the U-shaped frame 10 and under the braking control arm 12. It than runs over the rear limb (not shown) of the U-shaped frame immediately in front of it.

During a normal unwinding operation, the yarn is drawn from the yarn package, against a moderate tensioning force arising mainly or wholly from the pivoted member 8. The yarn acts on the arm 12, so that the latter is lifted to a raised position, against its weight and against the force of the spring 22, the yarn running generally straight, or with slight deviation, beneath it. The end of the pivoted member opposite to the arm 12 is thus in a lowermost position, so that the cord is loose around the pulley, so that it provides no or very little tensioning force.

It should be noted that, in this embodiment, the arm has to be lifted only slightly for the "brake" to be released. The yarn tension will then counteract the forces urging the arm to its lowest position, and will thus lift the arm further until there is a balance of forces between the yarn tension and the downward force of the arm. During running the arm has a continuous up and down movement as the opposing forces strive to remain in balance. During running the cord is wrapped loosely around the pulley but is not significantly affecting the unwinding tension.

When the machine stops, tension in the yarn is immediately lost, and the arm 12 falls, to adopt the position shown in the drawing. Thus the end of the pivoted member which carries the arm 12 falls, and the other and of the pivoted member rises, and so causes the cord to tighten around the pulley. Thus, a strong braking force is applied to the pulley, and the yarn package stops virtually immediately.

Figure 2:
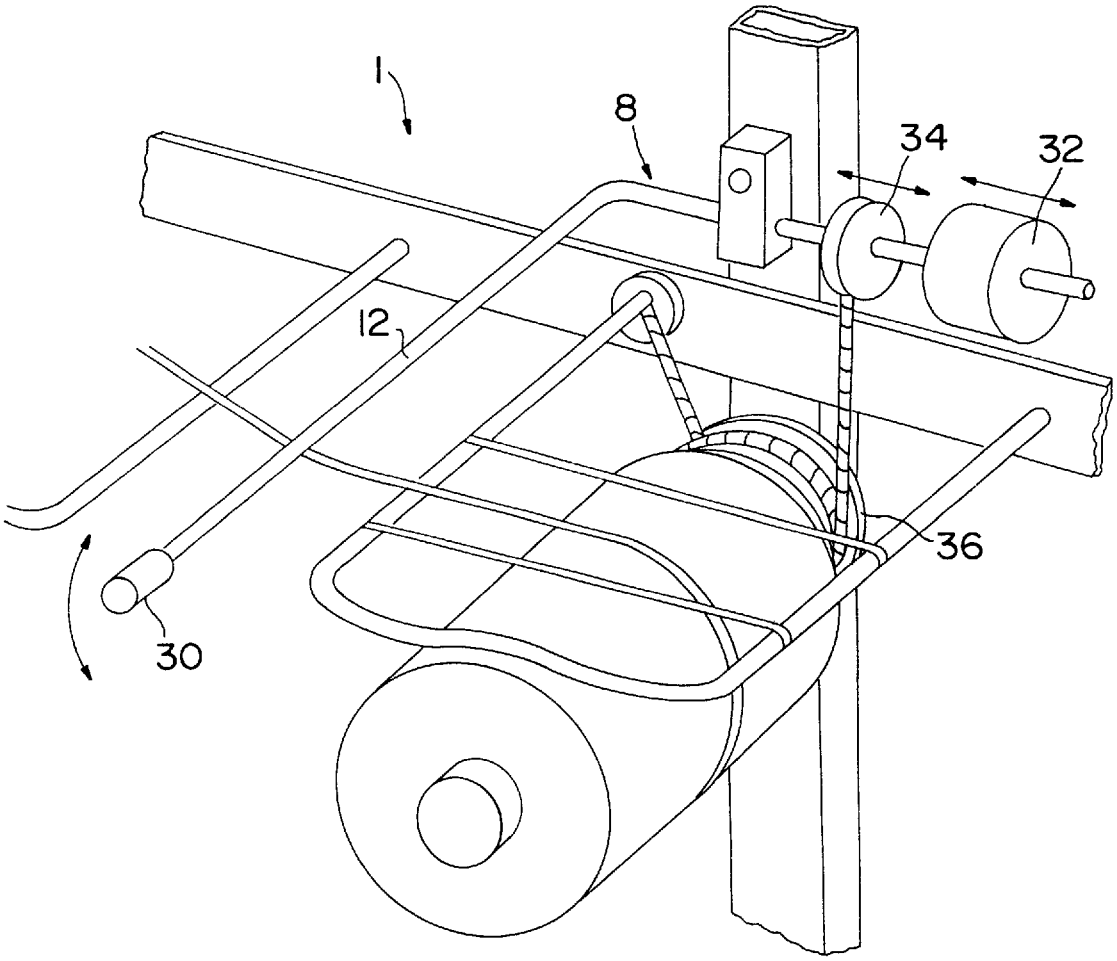
FIG. 2 shows, in schematic perspective view, a second embodiment.

The embodiment shown in FIG. 2 is similar to the embodiment shown in FIG. 1, the main differences being:

- the arm 12 has no downturned end portion; but it has an end stop 30
- the pivoted member 8, including the braking control arm 12, is formed from a single round bar, bent into an L-shape;
- the pivoted member 8 has an adjustable counterweight 32 carried on the opposite side of the pivot to the arm 12;
- the pivoted member 8 carries a further adjustable member 34 to which the cord is connected, whereby the connection point of the cord 20 to the pivoted member 8 may be varied, to alter the braking force.

In the view shown in FIG. 2, the pulley 36 can be seen at the inward and of the yarn package.

The invention described herein may be used with a vertical take-off and guide system, as described in our above-mentioned PCT patent application. Limbs of U-shaped members may be used as posts, about which a change in yarn travel direction is effected. A yarn for a given yarn package is suitably diverted upwards about the rear limb of the V-shaped frame associated with the yarn package immediately in front; and special posts may be provided for the frontmost yarn packages of the creel.

I claim:

1. A creel having a plurality of yarn package holders of the rotating type wherein (a) each yarn package holder has an operatively connected pulley and a flexible elongate element wound 360° or more around the pulley; and (b) each yarn package holder includes a quick stop mechanism operatively connected to the flexible elongate element, the mechanism having (i) a first normal yarn unwinding position with the flexible elongate element loosely contacting the pulley and allowing yarn to be freely pulled from the yarn package without the flexible elongate element imparting any significant tension to the pulley and (ii) a second yarn package quick stop position with the flexible elongate element being tightened around the pulley by the mechanism in response to a substantially total loss of pulling tension in the yarn being drawn from the yarn package so as to inhibit any further yarn from being pulled from the yarn package while the flexible elongate element is tight.

2. A creel according to claim 1, wherein the said mechanism for each yarn package holder comprises a braking control arm extending transversely with respect to a yarn being drawn from a yarn package located on the yarn package holder, the yarn running beneath the braking control arm, in contact with it, the yarn controlling the position of the braking control arm which in turn controls the tightness of the flexible elongate =member around the pulley.

3. A creel according to claim 2, wherein the braking control arm extends transversely from a pivoted member having a generally horizontal pivot, the flexible elongate member being secured to the pivoted member, the braking control arm being carried to one side of the pivot and the securement position of the flexible elongate member being on the opposite side of the pivot.

4. A creel according to claim 3, wherein the flexible elongate member is secured to the pivoted member at a selected position along the pivoted member on the opposite side of the pivot.

5. A creel according to claim 3, wherein the pivoted member is provided with an adjustable counter-weight or is biased by a spring or both.

6. A creel according to claim 3, wherein the one end of the flexible elongate member is connected to the pivoted member and the other end of the flexible elongate member is secured to a fixed part of the creel.

7. A creel according to claim 1, wherein each yarn package holder is associated with a frame member which defines an area through which the yarn may be drawn.

8. A creel according to claim 1, wherein the flexible elongate member is wound around the pulley for at least 540°.

9. A creel having a plurality of yarn package holders of the rotating type, each yarn package holder having a pulley and a flexible elongate member wound at least once around the pulley, and the flexible elongate member having one end and another end, and each yarn package holder having a mechanism which responds to loss of tension when yarn is drawn from a yarn package on the yarn package holder, to tighten the flexible elongate member around the pulley, to effect braking, wherein each yarn package holder is associated with a frame member which defines an area through which the yarn may be drawn, and wherein the frame member has substantially parallel bars which extend substantially parallel to the axis of the yarn package holder, the bars being spanned by two cross-members, at least one of which is adjustable whereby the spacing between them is adjustable.

10. A creel according to claim 8, wherein the frame member is U-shaped and each of said two cross-members is adjustable on the frame member.

* * * * *